US005124239A

United States Patent [19]

Fujita et al.

[11] Patent Number: 5,124,239

[45] Date of Patent: Jun. 23, 1992

[54] METHOD OF REPLENISHING PHOTOGRAPHIC PROCESSING APPARATUS WITH PROCESSING SOLUTION

[75] Inventors: Yoshihiro Fujita; Chuji Tsukada, both of Kanagawa, Japan

[73] Assignee: Fuji Photo Film Co., Ltd., Kanagawa, Japan

[21] Appl. No.: 618,863

[22] Filed: Nov. 28, 1990

[30] Foreign Application Priority Data

Nov. 30, 1989 [JP] Japan ..... 1-311229
Feb. 28, 1990 [JP] Japan ..... 2-47777
Feb. 28, 1990 [JP] Japan ..... 2-47779

[51] Int. Cl.[5] ..... G03C 5/00; G03C 7/00

[52] U.S. Cl. ..... 430/398; 430/372; 430/393; 430/399; 430/400; 430/428; 430/430; 430/434

[58] Field of Search ..... 430/372, 393, 398, 399, 430/400, 428, 430, 434

[56] References Cited

U.S. PATENT DOCUMENTS 4,025,344 5/1977 Allen et al. ..... 430/399
4,828,968 5/1989 Okutsu ..... 430/399

FOREIGN PATENT DOCUMENTS 0173203 5/1986 European Pat. Off. .
0326030 2/1989 European Pat. Off. .
62-099759 5/1987 Japan .
1-156743 6/1989 Japan .
1-254959 10/1989 Japan .
1-254960 10/1989 Japan .

*Primary Examiner*—Hoa Van Le
*Attorney, Agent, or Firm*—Sughrue, Mion, Zinn, Macpeak & Seas

[57] ABSTRACT

The present invention relates to a method in which water for preventing the concentration of processing solution in a processing tank from being increased due to evaporation and a replenisher for avoiding a lowering of the effectiveness of the processing solution are added to the processing tank of a photographic processing apparatus. Before the processing tank is replenished with a replenisher, the processing tank is replenished with water by an amount corresponding to the amount of water evaporated therefrom until the liquid surface level reaches the original liquid surface level i.e. replacing evaporated water, and then, the processing tank is replenished with replenisher. Thereafter, the processing solution is discharged by an amount equal to the amount of replenisher added in order to return the liquid surface level to the original liquid surface level. Thus, the performance of the processing solution can be restored while the concentration of the processing solution is kept constant.

10 Claims, 7 Drawing Sheets

DEVELOPING TANK
BLEACHING TANK
BLEACH-FIXING TANK
FIXING TANK
WATER-RINSING TANK
WATER-RINSING TANK
STABILIZING TANK
(12)
(14)
(16)
(18)
(22)
(24)
(26)
CT
P
V1
V2
VR
F
76
56
33
32
35
36
44
38
34
42
52
54
55
58
67
72
73
66
64
62

METHOD OF REPLENISHING PHOTOGRAPHIC PROCESSING APPARATUS WITH PROCESSING SOLUTION

BACKGROUND OF THE INVENTION

1. Field of the Invention

The present invention relates to a method of replenishing a photographic processing apparatus with processing solution and, more particularly, is directed to a method of replenishing a photographic processing apparatus with processing solution for replenishing a processing tank with processing solution such as a water for preventing the concentration of the processing solution from being increased due to evaporation and a replenisher for preventing a processing solution from being lowered in performance.

2. Description of the Related Art

A conventional automatic developing apparatus automatically develops, bleaches, bleach-fixes, rinses with water and dries photosensitive materials such as photographic film or the like. In this conventional automatic developing apparatus, the temperature of each processing solution such as developing solution, bleaching solution, bleach-fixing solution or the like is controlled to a predetermined value, resulting in a large amount of evaporation of the processing solution, rendering the processing solution high in concentration. In order to solve this problem, at a predetermined timing (e.g., in the morning, when the automatic developing apparatus is turned on), each processing tank is replenished with water by a constant amount, and only when the liquid level of the processing tank is lowered beyond a predetermined value, the tank is replenished with water until the level of the processing liquid is restored to its original level.

On the other hand, the processing performance of the processing solution is lowered due to fatigue caused by the process of the photosensitive material, deterioration caused by oxygen in the air and so on. Accordingly, the processing solution is replenished with a replenisher for restoring the effectiveness of the processing solution.

However, the evaporation amount of the processing solution is changed with ambient temperature, the amount of the photosensitive material which has been processed, and so on. For this reason, in actual practice, when water of a constant amount is added to the processing solution, in fact an amount of water different from the actual evaporation amount is added to the processing liquid, thus making it difficult to keep the concentration of the processing solution constant. Further, in the above method in which the processing tank is replenished with water only when the liquid level of the processing tank is lowered, if the processing is replenished with a replenisher in response to the amount of the photosensitive material which has been processed, the replenishment of water cannot be corrected in correspondence with the amount of evaporation which has occurred. Therefore, it becomes difficult to keep the concentration of the processing solution constant.

SUMMARY OF THE INVENTION

Accordingly, it is an object of the present invention to provide an improved method which can eliminate the aforenoted shortcomings and disadvantages of the prior art.

More specifically, it is an object of the present invention to provide a method of replenishing a photography processing apparatus with processing solution whereby an amount of water corresponding to the evaporation amount can be added, and further, whereby the processing tank can be replenished with a replenisher without changing the concentration of the processing solution.

In order to attain the above-mentioned objects, according to a first aspect of the present invention, a processing tank of the photographic processing apparatus is replenished with a water at a predetermined timing so that the liquid level in the processing tank is restored up to an original liquid level, and after the liquid level of the processing tank is made equal to the original liquid level by the water replenishment, the processing tank is replenished with a replenisher for restoring the performance of the processing solution and the processing solution in the processing tank is discharged from the processing tank by the amount substantially equal to the amount of the replenisher added.

The liquid can be discharged from the processing tank by an overflow operation or pumping-out by a pump or the like.

First, when the processing solution is standing in the processing tank immediately before the overflow, the processing tank is replenished with water at a predetermined timing until the processing solution in the processing tank is overflown, and after the processing solution in the processing tank starts overflowing, the processing solution in the processing tank may be overflown while the processing tank is being replenished with the replenisher. Thus, the liquid level in the processing tank is restored up to the liquid level positioned immediately prior to the overflow.

Further, as a second aspect of the present invention, a water component evaporation ratio between the amount of water evaporated from a processing tank (the reference processing tank) to which the replenisher is added, and another processing tank (the follow-up processing tank) is obtained, and when the reference processing tank is replenished with water, the follow-up processing tank may be replenished with water by the amount corresponding to the ratio.

The reference processing tank and the follow-up processing tank in this case can be arbitrarily selected from among any of the tanks ranging from a developing tank to a water-rinsing tank of the photographic processing apparatus. The amounts of water evaporated from the reference processing tank and the follow-up processing tank during a predetermined period of time are empirically determined by a measuring-process or the like. Then, if the reference processing tank is provided with a liquid level sensor, the follow-up processing tank can be replenished with water on the basis of the water component evaporation ratio and the amount of water evaporation in the reference processing tank. Therefore, another liquid level sensor need not be provided in the follow-up processing tank. Further, in case that a predetermined amount of water is automatically added to the reference processing tank after the elapse of a predetermined period of time, the reference processing tank does not need the liquid level sensor either. The water for replenishment of the processing tank may be constituted by only water, or it may be constituted by water containing the replenisher as one part, that is, a liquid containing water as the main component. Also, the water can be constituted by the replenisher.

In the present invention, as a precondition, let us assume that a processing solution amount $V_1$ brought into the tank from the preceding tank by adhering to the photosensitive material, and a processing liquid amount $V_2$ taken into the next processing tank, are approximately equal to each other. Generally, in a photographic processing apparatus, a number of processing tanks are provided, ranging from a developing tank to a water-rinsing tank. In the present invention, the processing tank to which the replenisher is supplied, that is, the afore-said reference processing tank, is preferably a tank having the same amount of processing solution brought into it along with the photosensitive material as is carried out of it into the next processing tank with the material, other than a developing tank that is provided in the first stage of processing, that is, for example, a tank utilized in the later stage of a bleaching processing tank, or a bleach-fixing tank. If the processing solution amount $V_1$ adhering to a unit area of the photosensitive material and brought into the tank from the preceding processing tank and the processing solution amount $V_2$ adhering to the same unit area and taken into the next processing tank are not equal to each other, the present invention can be applied to a processing tank in which the amount of the replenisher per unit area of the photosensitive material is 5 times or more (more preferably 10 times or more) of the absolute value $(1V_1-V_21)$ of the difference between the processing solution amounts $V_1$ and $V_2$. The reason for this is that, if the amount of the replenisher is small, the processing solution cannot be discharged from the processing tank by overflow, and so on.

As described above, according to the present invention, the processing tank is replenished with water for correcting water evaporated at such a predetermined timing as after a predetermined amount of photosensitive material has been processed first, and then the replenisher is supplied. That is, the water component for correcting for the water evaporated and the replenisher can be independently supplied to the processing tank so as to allow the evaporated water replacement component to be corrected accurately, thereby preventing change in the concentration of the processing liquid. Further, if the follow-up processing tank is replenished with water on the basis of the water component evaporation ratio at the same timing as that of the reference processing tank, change in concentration of the processing solution can be reduced in the follow-up processing tank.

The timing of the replenishment of the tank with water may be set at any suitable point, for example, after a predetermined amount photosensitive material has been processed without replenishing the tank with the replenisher for example, 50 rolls of negative film (135 size, each having 24 exposures), or when a predetermined period of time has passed after the processing is started, or when the surface level of the processing solution has lowered down to a predetermined level. The water replenishment procedure for replenishing the tank with water in an amount corresponding to the amount by which the liquid level in the processing tank is lowered due to evaporation during the period of time from the end of processing of the day before to the start of processing of each day may be performed at the start of processing of each day.

Further, in the present invention, the processing solution discharged by an overflow procedure or the like in an amount corresponding to the amount of the replenisher added is not merely disposed of, but rather, is supplied to an adjacent tank, i.e., transferred, for example, from a fixing tank to a bleach-fixing tank as the replenisher or alternatively from a water-rinsing tank to a fixing tank, so as to recycle the active processing solution.

Furthermore, this invention is also superior to another method of correcting for evaporation in a processing tank by using a monitor water tank, which has been proposed (Japanese Patent Application Laid-Open Nos. 1-254959 and 1-254960). According to the present invention, the replacement of evaporated water can be accurately carried out without using such a monitor water tank.

As described above, according to the present invention, since the replenisher is added to the tank after the liquid level has been restored to the original liquid level by replenishing the tank with water, the proper concentration of processing solution can be maintained, while at the same time, the water lost by evaporation can be accurately replaced.

In the present invention, the term "processing solution" includes such a water as a rinsing water for rinsing process.

The preceding, and other objects, features and advantages of the present invention will be apparent from the following detailed description of preferred embodiments when read in conjunction with the accompanying drawings, in which like reference numerals are used to identify the same or similar parts in the several views.

DESCRIPTION OF THE PREFERRED EMBODIMENTS

The present invention will now be described in detail with reference to the drawings.

Figure 1:
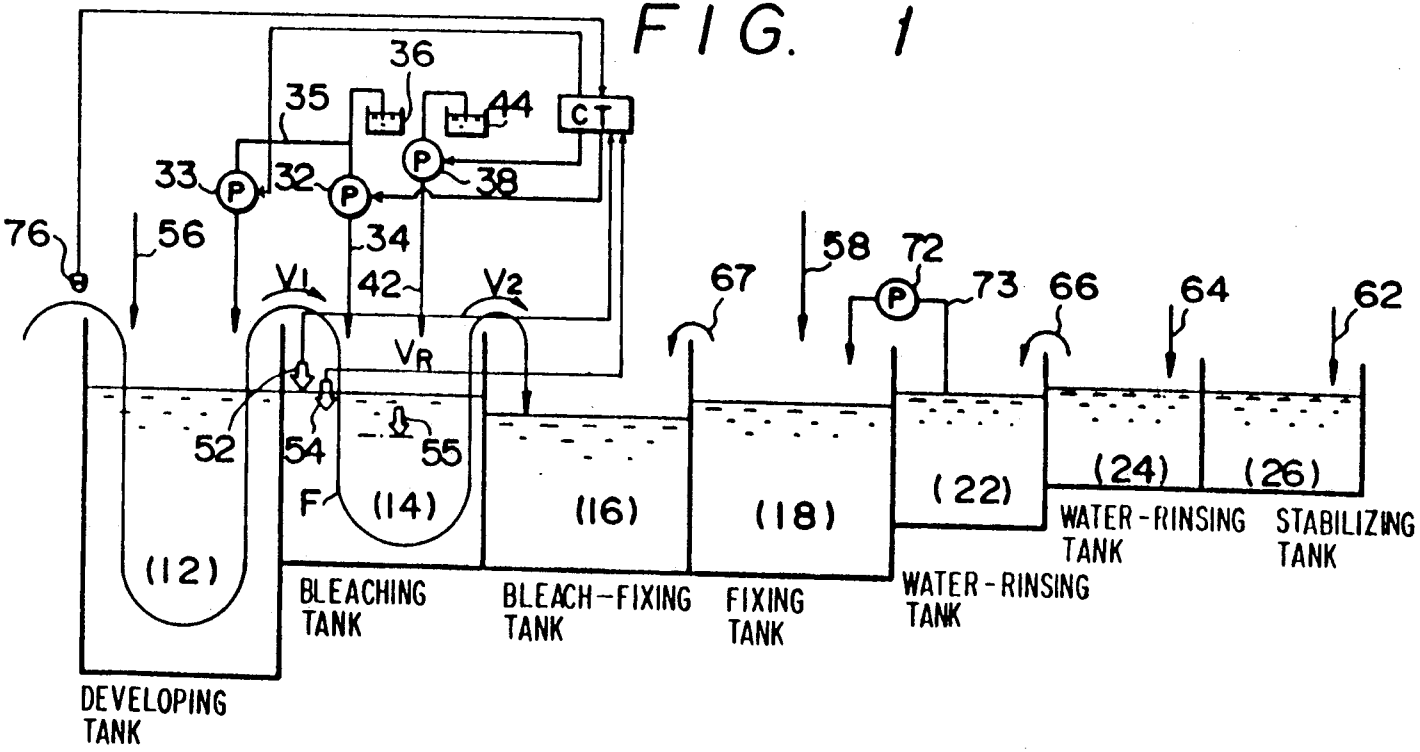
FIG. 1 is a schematic diagram showing an automatic developing apparatus to which the present invention is applied.

FIG. 1 shows an automatic developing apparatus to which the present invention is applied.

As shown in FIG. 1, this automatic developing apparatus is provided with a developing tank 12, a bleaching tank 14, a bleach-fixing tank 16, a fixing tank 18, water-rinsing tanks 22 and 24 and a stabilizing tank 26 connected in series. These tanks are filled with predetermined amounts of processing solutions such as color developing liquid, bleaching liquid, bleach-fixing liquid, fixing liquid, rinsing water and stabilizing liquid. The automatic developing apparatus is provided with conveying means (not shown) which sequentially conveying a photosensitive material F to each of the processing tanks.

The bleaching tank 14 to which the present invention is applied is replenished with the water which is supplied from a tank 36 through a pump 32 and a pipe 34 and is replenished with the bleaching solution replenisher which is supplied from a tank 44 through a pump 38 and a pipe 42.

Further, the bleaching tank 14 is provided with level sensors 52 and 54. The level sensor is located at a position corresponding to the surface level of the bleaching solution when the tank 14 is filled with the necessary amount thereof, that is, at a position where the original liquid surface level to be maintained can be detected, whereas the level sensor 54 is located at a position corresponding to a liquid surface level lowered from the original liquid surface level by a predetermined amount, so that a given drop in the level of the bleaching processing solution can be detected. The level sensors 52 and 54, and a control apparatus CT are connected in such a way that signals output from the level sensors 52 and 54 are input to the control apparatus CT. The processing solution in the bleaching tank 14 is discharged as an overflow if the liquid level thereof is caused to exceed the original liquid surface level.

The pipe 34 for replenishing the bleaching tank 14 with water communicates with a pipe 35 through which water is transferred to the developing tank 12. This pipe 35 is provided with a pump 33 and water is transferred into the developing tank 12 by means of this pump 33. The amounts of water to be added to the developing tank 12 and the bleaching tank 14 respectively are determined on the basis of an evaporated water amount, ratio obtained by measuring beforehand the amounts of water evaporated from the developing tank 12 and the bleaching tank 14 respectively in a predetermined period of time. In order to replenish the tanks 12 and 14 with water in amounts corresponding to the evaporated water amount ratio, ratios between respective revolution rates, respective operation times and respective discharging amounts, and so on, of the pumps 32 and 33 are arranged in advance so as to be equal to the evaporated water amount ratio. Alternatively, only one pump is provided and the pipes 34 and 35 are provided with orifices or the like. Then, the ratio between the diameters of these orifices is determined so as to be equal to the evaporated water amount ratio to make the ratio of the amounts of water added to replenish the two respective tanks correspond to the ratio of the amounts of evaporated water to be replaced.

The developing tank 12, the fixing tank 18 and the stabilizing tank 26 are also provided with pipes 56, 58 and 62. The water-rinsing tank 24 is provided with a water supply pipe 64 which replenishes the tank with water for rinsing. From the water-rinsing tank 24, the rinsing water is supplied to the preceding processing tank via an overflow 66, and from the fixing tank 18, the fixing solution is supplied to the preceding processing tank via an overflow 67. The rinsing water of the water-rinsing tank 22 is supplied to the fixing tank 18 through a pump 72 and a pipe 73.

The control of these pumps and the control of the supply of liquid are performed by control means (not shown).

The developing tank 12 has at its inlet a sensor 76 for detecting whether or not the photosensitive material is being passed therethrough, and this sensor 76 is connected to the control apparatus CT.

Figure 2A:
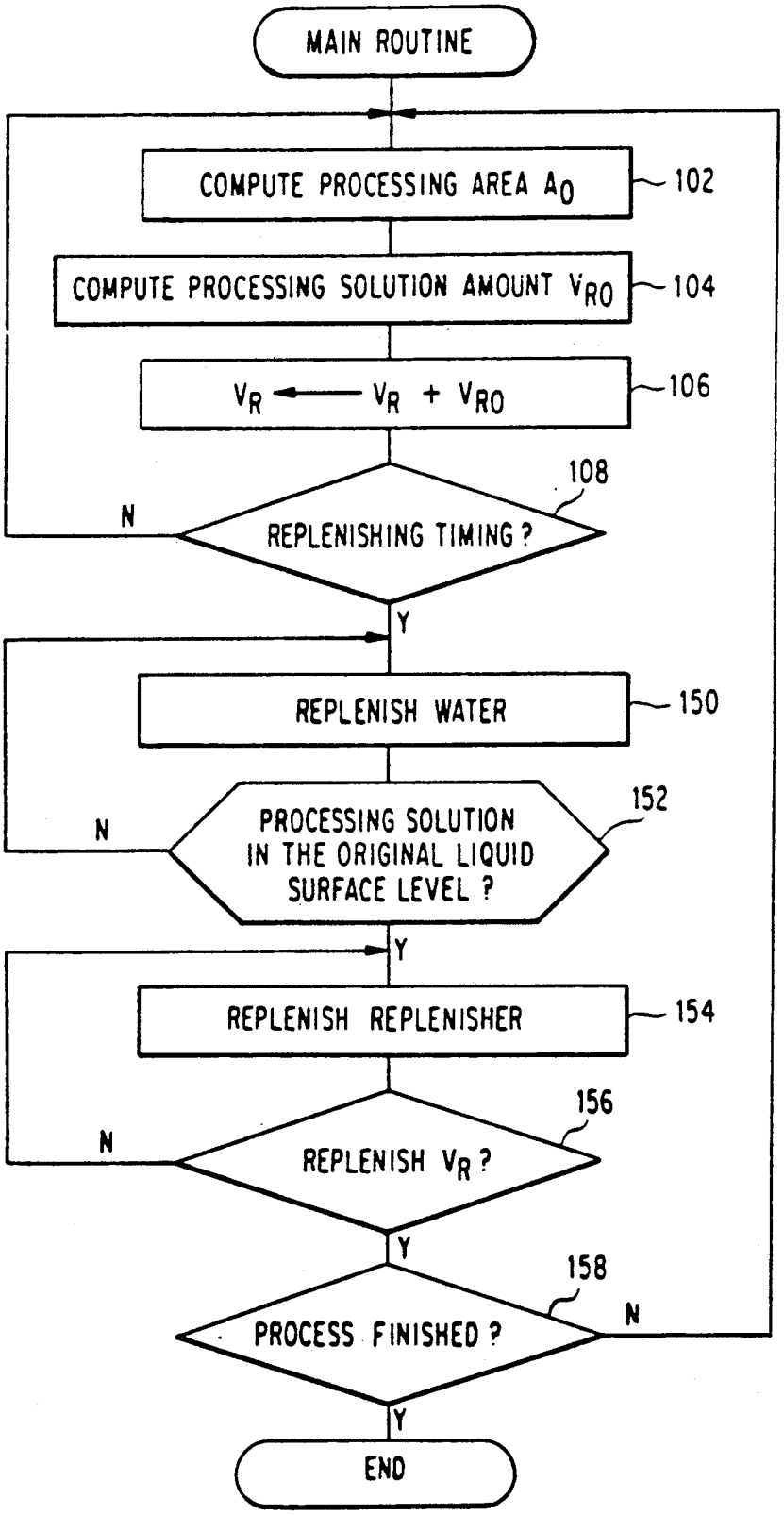
FIGS. 2A and 2B are flowcharts to which references will be made in explaining two respective control routines of a first embodiment of the present invention.
Figure 2B:
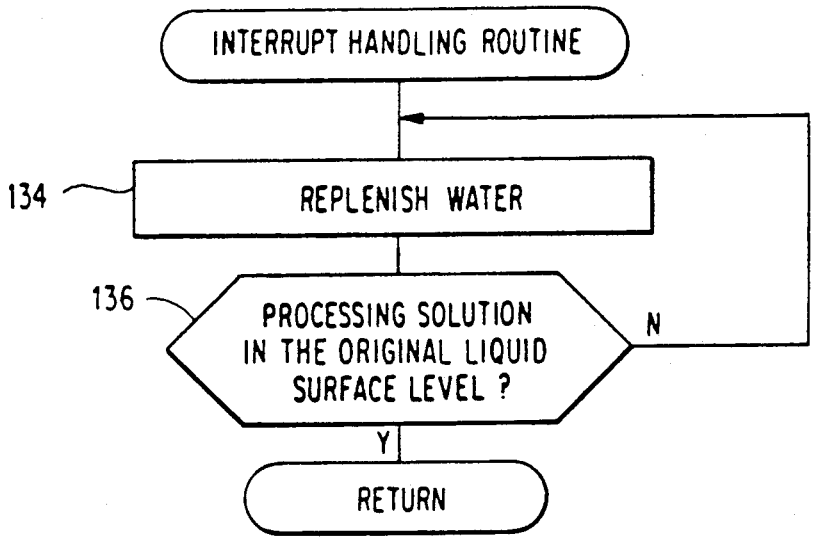

The operation of the first embodiment will be described with reference to the control routines of FIGS. 2A and 2B. FIG. 2A shows the main routine of this embodiment, and FIG. 2B shows an interruption handling routine thereof.

The photosensitive material F is sequentially carried from the developing tank 12 into the bleaching tank 14 and then into the bleach-fixing tank 16, for each respective process, including developing, bleaching and so on, and is then taken out of the stabilizing tank 26 and dried.

The method for replenishing the bleaching tank 14 with replenisher will now be explained. The control apparatus CT computes the total process area $A_0$ of the photosensitive material F which has been processed during a predetermined period, on the basis of input from the sensor 76 and the width of the photosensitive material F, and an amount $V_{R0}$ of replenisher necessary for storing the performance of the bleaching processing solution on the basis of the total process area $A_0$, and adds the amounts $V_{R0}$ to thereby obtain an added value $V_R$ (in steps 102, 104 and 106).

When the amount of the photosensitive material F which has been processed, i.e., the processed area, comes up to the amount corresponding to, for example, 50 rolls of negative films, it is determined to be the replenishing timing for replenisher (in step 108). If the replenishing timing is determined in step 108, before the replenisher is supplied, the pump 32 is driven to replenish the bleaching tank 14 with water until the liquid surface level in the bleaching tank 14 reaches the original liquid surface level, that is, until the liquid surface level is detected by the level sensor 52 (at steps 150 and 152).

The developing liquid amount $V_1$ per unit area brought to the bleaching tank 14, along with the photosensitive material F from the developing tank 12 and the bleaching solution amount $V_2$ per unit area taken out therefrom into the bleach-fixing tank 16 along with the photosensitive material F are approximately equal to each other so that, if the liquid surface level is lowered after the photosensitive material F of the predetermined amount has been processed, it can be concluded that this lowered liquid surface level is brought about by the evaporation of water. Accordingly, if the lowered liquid surface level is returned to the original liquid surface level by replenishing the tank with water, it means that the evaporated water is replaced by the water. Therefore, as stated above in step 150, the pump 32 is driven to supply the water from the tank 36 to the bleaching tank 14.

In that case, in other processing tanks such as the developing tank 12, the bleach-fixing tank 16, the fixing tank 18 and so on, it is preferable to supply water thereto as will be explained later in the second embodiment. In the replenishment of the tanks with water, the ratio between respective amounts of water evaporated from the bleaching tank 14 and each of the other processing tanks is calculated beforehand, and the ratio between the respective revolution rates of the pumps 32 and 33 is determined in proportion to each of the above-mentioned calculated ratios, for the water replenishment operation of the respectively corresponding tanks so that the operation of the pumps 32 and 33 may be started and stopped simultaneously.

It is to be noted that the replenishing timing may be selected on whatever basis is suitable, such as when the liquid surface level in the bleaching tank 14 is lowered to the liquid surface level which is detected by the level sensor 54, or when the liquid surface level is detected by the level sensor 55 which detects that the liquid surface level of the bleaching tank 14 is lowered abnormally. In the latter case, when the liquid surface level is lowered to the level detected by the level sensor 55, the enough water is added to the tank by the pump 38 to increase the liquid surface to the liquid surface level detected by the level sensor 52, that is, the original liquid surface level. However, if the liquid surface level is not detected by the level sensor 52 in a predetermined period of time after the water is replenished by the pump 38, it can be concluded that there is an abnormal condition such as processing solution leakage from the tank or the like.

Alternatively, instead of the level sensor 52, a sensor for detecting that processing solution is overflowing from the bleaching tank 14 is provided and water is supplied until this sensor detects the condition of overflow, that is, until the tank is full.

After the liquid surface level is restored to the original liquid surface level by replenishing the tank with water, the replenisher (amount $V_R$) is supplied to the bleaching tank 14 by using the pump 38 and the performance of the bleaching solution is restored (in steps 154 and 156). The amount $V_R$ of the replenisher to be supplied is proportional to the amount (processed area) of the photosensitive material F which has been processed. Since the replenisher is supplied after the liquid level in the tank has been restored to the original liquid surface level, the bleaching solution within the bleaching tank 14 is caused to overflow by the amount $V_R$ of the replenisher supplied, and therefore discharged from the bleaching tank 14. Thus, the fatigue of the bleaching solution within the bleaching tank 14 is remedied and the concentration of the bleaching solution is accurately returned to the concentration it had before the predetermined amount of the photosensitive material F was processed by the bleaching solution. In step 158, it is determined whether or not the processing of the photosensitive material F to be processed is finished. If the processing is not finished, in other words, it there is still some material to be processed, as represented by a NO at step 158, the routine returns to step 102 and the above-mentioned steps are repeated. On the other hand, if the processing of the photosensitive material F is finished as represented by a YES at step 158, this repeating routine is stopped.

Thereafter, if the processing of photosensitive material is not performed for a long period of time, the bleaching solution evaporates and the liquid surface level is lowered. Under these circumstances, when the liquid surface level is detected by the level sensor 54, an interrupt handling routine shown in FIG. 2B is started, wherein the bleaching tank 14 is replenished with water and the liquid surface level is returned to the original liquid surface level (in steps 134 to 136).

In this fashion, by repeating the replenishment of the processing tank with water and with the replenisher, it is possible to always keep the processing solution at the predetermined concentration while still periodically restoring the performance of the processing solution.

The arrangement of this embodiment as described above enables water lost by evaporation to be replaced without changing the concentration of the processing solution.

Figure 3A:
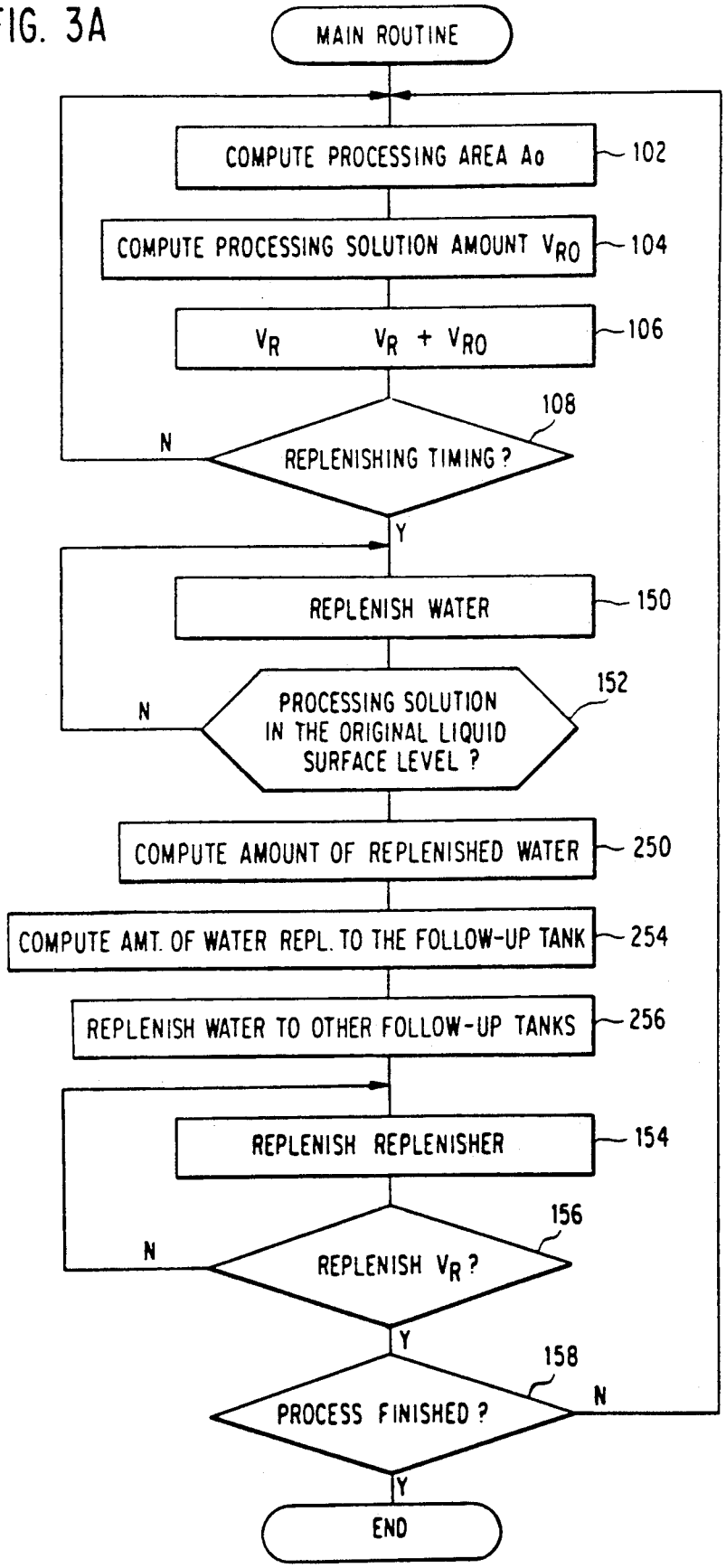
FIGS. 3A and 3B are flowcharts to which references will be made in explaining two respective control routines of a second embodiment of the present invention.
Figure 3B:
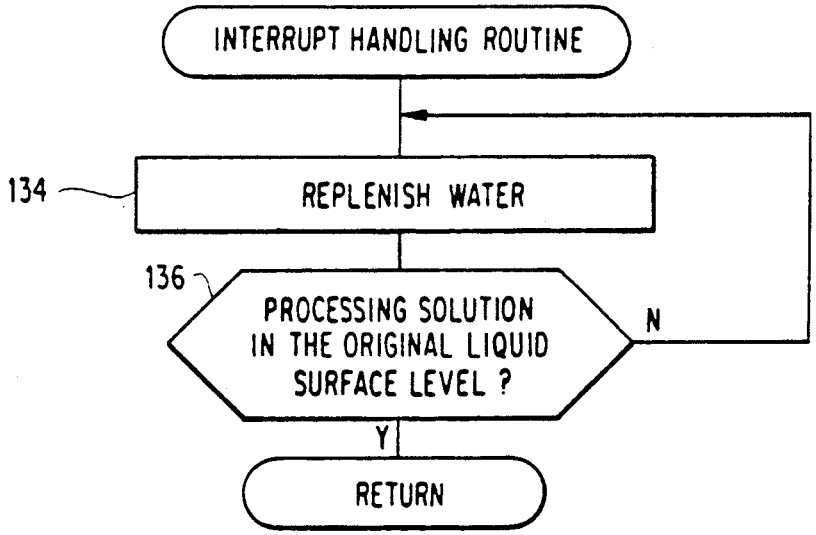

A second embodiment of the present invention will be described with reference to FIGS. 3A and 3B. In FIGS. 3A and 3B, like parts corresponding to those of FIGS. 2A and 2B are marked with the same references and therefore need not be described.

In this embodiment, water is supplied to other processing tanks such as the developing tank 12, the bleach-fixing tank 16, the fixing tank 18 or the like in a way similar to that used for the bleaching tank 14 which is employed as the reference processing tank. The amount of water added is based on a ratio of amounts of water evaporated which is determined by measuring the respective amounts of water evaporated from the bleaching tank 14 and each of the other processing tanks. More particularly, after the water is added to the bleaching tank 14, the amount of water supplied by the pump 32 per unit time and the time of operation of the pump are multiplied to compute the amount of water replenished to the bleaching tank 14 (in step 250). Then, by multiplying the amount of water replenished to the bleaching tank 14 by the ratio of respective amounts of water evaporated, the amount of water to be added to each of the other tanks is computed (in step 252). Then, in response to the computed replenishing water amounts, the pumps 32 and 72 and so on are driven to replenish the other follow-up tanks with water (in step 254).

In the present invention, the above method for correcting for the amount of water evaporated from the reference processing tank can be modified in a variety of ways. The following are examples of such modifications.

Figure 4:
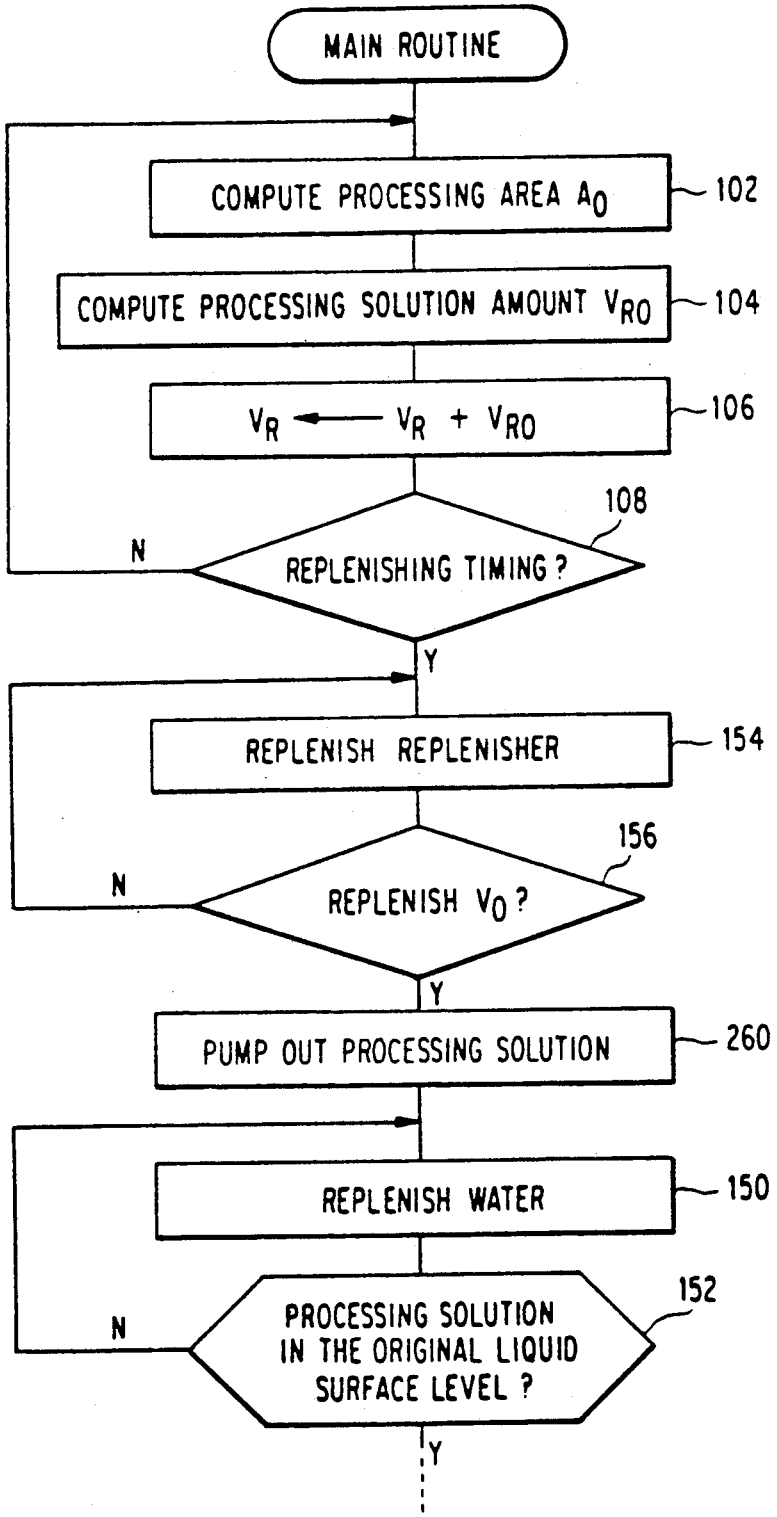
FIGS. 4 and 5 are flowcharts to which references will be made in explaining a particular portion of two respective modified examples of the present invention.

A first modified example includes, as shown in FIG. 4, a step in which a replenisher is replenished to the tank in a response to a predetermined amount of the photosensitive material which has been processed at such a timing as after the photosensitive material of the predetermined amount has been processed, a step in which the processing solution is pumped out of the processing tank (in step 260) by the amount determined by subtracting the amount of processing solution taken into the next processing tank from the total amount of the replenicher combined with the amount of processing solution brought into the processing tank from the preceding processing tank which is the processing tank provided upstream of the processing tank in question, and a step in which the processing tank is replenished with water to restore the liquid surface level of the processing tank to the original liquid surface level. The processing solution is pumped out of the processing tank by the use of a pump.

In this embodiment, the processing tank is replenished with processing replenisher at a replenishing timing in order to restore the performance of the processing solution, and the tank is positively replenished with water corresponding to the amount of water evaporated regardless of the amount $F_V$ of the replenisher added. More specifically, at the replenishing timing, the processing tank is replenished with replenisher in a replenishing amount $V_R$ corresponding with the amount of photosensitive material which has been processed, and an amount $V_0$ of processing solution is pumped out of the processing tank. This pumped out amount $V_0$ is the amount $(V_{10}-V_{20})$ which results from subtracting the amount $V_{20}$ of processing solution which is taken into the next processing tank along with the photosensitive material from the processing tank in question from the sum of the amount $V_{10}$ of processing solution brought into the processing tank from the preceding processing tank along with the photosensitive material and the amount of the replenisher added. In other words, an amount corresponding to the net gain in the amount of processing solution in the processing tank due to unequal transfer of processing liquid from tank to tank and to the addition of the replenisher is pumped out of the processing tank. Thus, if the liquid surface level after the processing solution has been pumped out is lower than the original liquid surface level, this lowered liquid surface level can be regarded as having been lowered by evaporation. Accordingly, if this lowered liquid surface level is restored to the original liquid surface level by replenishing the tank with water, then an amount of water corresponding to only the amount evaporated is properly replenished and thus the concentration of the processing solution can be maintained. It is preferable that the water be added each time the lowered liquid surface level is detected while monitoring the liquid surface level during the interval between the replenishing of the tank with the replenisher and the processing solution pumping out operation.

Also, it is preferable that the amount of processing solution carried into the processing tank by the photosensitive material and the amount of processing solution escaping with the photosensitive material be measured beforehand experimentally and then expressed in the form of the amount $V_1$ of processing solution brought in per unit area of the photosensitive material and the amount $V_2$ of processing solution escaping.

Further, it is preferable that the step in which the processing tank is replenished with the replenisher and the step in which the processing solution is pumped out of the processing tank are executed at short intervals, that is, after only a very small amount of photosensitive material is processed (e.g., several rolls of the negative film). By executing the aforementioned two steps each time a predetermined small amount of the photosensitive material is processed, it is possible to keep the concentration of the processing solution accurately constant.

Figure 5:
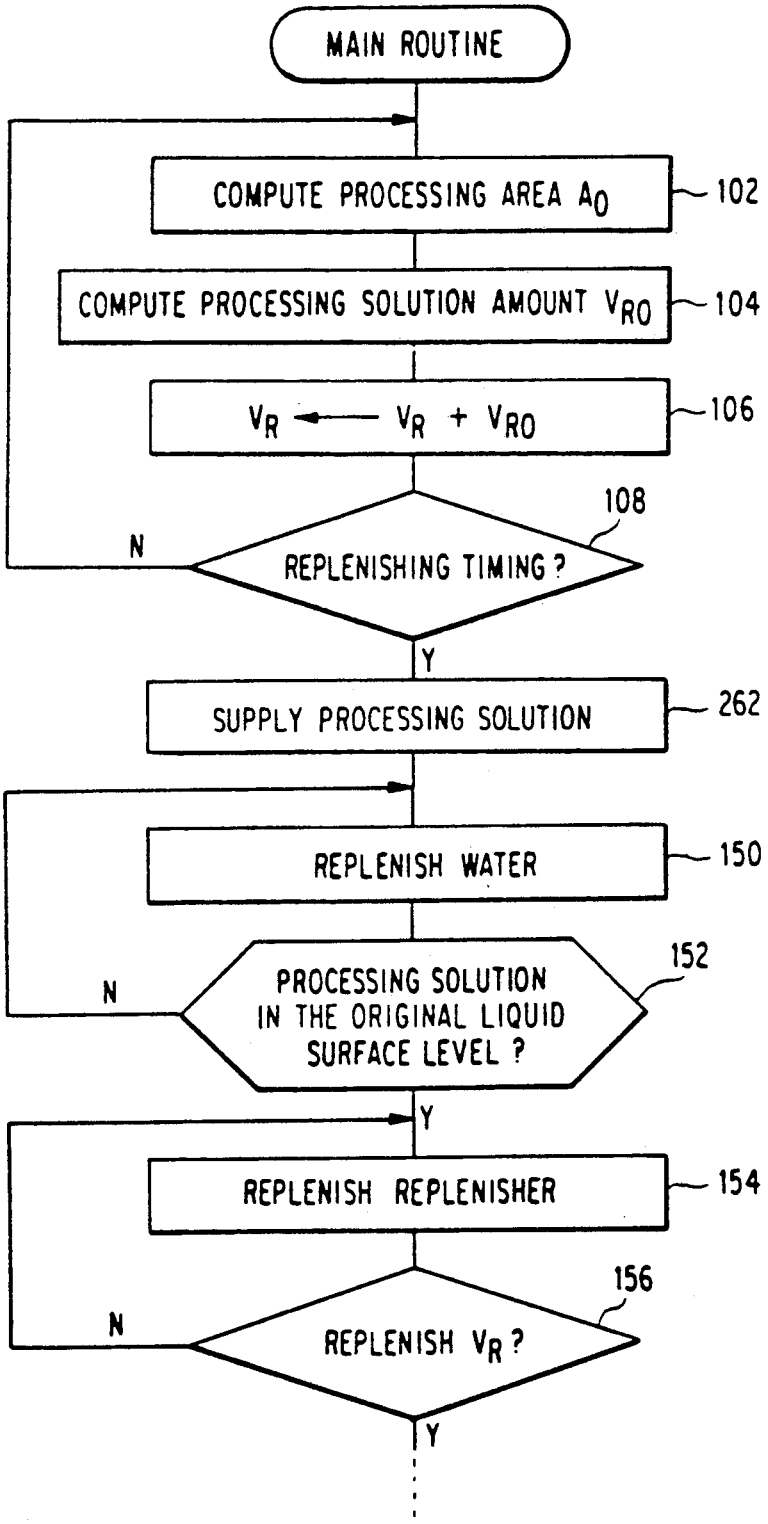

Another modified example of a method of correcting for the amount of processing solution evaporated from the reference processing tank will be explained. This modified example is appropriately applied to the case in which the amount of processing solution escaping is larger than the amount of processing solution carried into the processing tank. As shown in FIG. 5, this modified example includes a step in which, after photosensitive material of a predetermined amount is processed in the processing tank and an amount of processing solution corresponding to the difference between the amount of processing liquid escaping along with the processed photosensitive material and the amount of processing solution carried into the processing tank with the material, (i.e., the net amount of processing solution lost to the outside of the processing tank during the processing of the photosensitive material) (step 262), the processing tank is replenished with water until the liquid surface level reaches the liquid surface level it had originally before the photosensitive material was processed, and a second step in which some of the processing liquid in the replenished tank is made to overflow from the tank as a result of supplying a predetermined amount of processing replenisher to the processing tank.

Since the amount V of processing solution (corresponding to the difference between the total amount $V_{10}$ of the processing solution carried into the processing tank from the preceding processing tank by the photosensitive material and the total amount $V_{20}$ escaping from the processing tank along with the photosensitive material) is supplied to the processing tank at the replenishing interval, this modified example is the optimal method for the case in which the amount $V_{20}$ of the processing solution escaping with the photosensitive material is considerably larger than the amount of the processing solution amount $V_{10}$ brought into the processing tank. This embodiment can be applied to a first processing tank such as a developing tank or the like in which no processing solution derives from a preceding processing tank.

In a processing tank in which the processing solution escaping is large in amount or in a processing tank in which no processing solution is brought from a preceding tank, the liquid surface level after the escape of processing solution along with the photosensitive material from the processing tank is lowered by the evaporation of the water component of the processing solution while the photosensitive material is being processed. For this reason, the tank is replenished with water until the surface level of the processing solution reaches the level it was originally at before the processing of the photosensitive material and thus the concentration of the processing solution is restored to the concentration which existed before the evaporation of the processing solution. Thereafter, in a similar way as in the first embodiment, an amount of replenisher corresponding to the amount of photosensitive material processed since the previous replenishing operation is supplied, and processing solution of the same amount is caused to overflow so as to return the processing liquid to condition before any significant deterioration of it's performance, and before significant evaporation of the water component has taken place.

The amount of the replenisher which is added after the water component has been added to correct for loss of processing solution by evaporation of water, is determined by subtracting the above-mentioned amount V of processing solution from the amount of replenisher which would be required to restore the performance of the processing solution based on the area of the photosensitive material processed since the previous replenishment operation, if no water component were evaporated or if the evaporated amount of water component were small.

The processing solution or the water can be added automatically after a predetermined amount of photosensitive material is processed or after the elapse of a predetermined period of time. Further, the processing solution or the water may be added after the liquid surface level falls to a level within a predetermined range of values.

Furthermore, in the step where an amount of processing solution the same as the predetermined amount of replenisher supplied is made to overflow, processing solution in excess of the original liquid surface level is allowed to escape by an overflow-process comprising the supplying of replenisher to the processing tank after the tank has been replenished with water up to its original surface level or, alternatively, actively pumping the processing solution out with a pump or the like.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. A method of replenishing a photographic processing apparatus with processing solution for replenishing with processing solution a processing tank provided in a photographic processing apparatus and storing a processing solution for processing a photosensitive material, said method comprising the steps of:

replenishing said processing tank with water at a predetermined timing until the level of the surface of the liquid in said processing tank reaches an original liquid surface level; and after said liquid surface level of said processing tank has been restored to said original liquid surface level, replenishing said processing tank with a replenisher for restoring the performance of said processing solution, and discharging the processing solution from said processing tank by an amount substantially equal to the amount of the replenisher added to said processing tank.

2. The method according to claim 1, wherein said predetermined time is one of: the time when the photosensitive material has been processed by a predetermined amount, the time when a predetermined period of time has been passed the start of the process of said photosensitive material, the time when the liquid surface level in said processing tank has been lowered to a predetermined liquid surface level, and the time when the processing of said photosensitive material starts.

3. The method according to claim 1, wherein said discharge from said processing tank is conduced through an overflow.

4. The method according to claim 1, wherein said discharge from said processing tank is conduced through a pumping-out process of a pump.

5. The method according to claim 1, wherein said processing tank is a tank constituted such that an amount of liquid carried in said tank by said photosensitive material is substantially equal to an amount of liquid carried out of said tank by said photosensitive material.

6. The method according to claim 1, wherein said processing tank is a tank constituted such that an amount of the replenisher per unit area of said photosensitive material is five times or more of the absolute value of the difference between an amount of liquid carried into said tank by said photosensitive material and an amount of liquid carried out of said tank by said photosensitive material.

7. The method according to claim 1, further comprising a step of supplying the processing solution discharged from said processing tank to another processing tank.

8. The method according to claim 1, wherein the amount of the replenisher added to replenish said processing tank is determined on the basis of the amount of said photosensitive material which has been processed.

9. The method according to claim 1, further comprising steps of obtaining a water component evaporated amount ratio between said processing tank and another processing tank, and of replenishing said another processing tank with water by an amount based on the water component evaporated amount ratio when said processing tank is replenished with water.

10. The method according to claim 1, further comprising the step of supplying the processing solution to said processing tank by an amount corresponding to the difference between an amount of the processing solution carried into said processing tank by said photosensitive material and an amount of the processing solution carried out of said processing tank by said photosensitive material, before said processing tank is replenished with water.

* * * * *